United States Patent [19]

McCracken

[11] Patent Number: 5,029,706

[45] Date of Patent: Jul. 9, 1991

[54] WRENCH STORAGE ARRANGEMENT FOR A POWER TOOL

[75] Inventor: Robert E. McCracken, Easley, S.C.

[73] Assignee: Ryobi Motor Products Corp., Pickens, S.C.

[21] Appl. No.: 617,141

[22] Filed: Nov. 23, 1990

[51] Int. Cl.[5] ..... A45C 11/26

[52] U.S. Cl. ..... 206/349; 206/376; 206/216; 81/177.4; 81/490; 144/2 R; 144/136 R; 279/1 K; 409/182

[58] Field of Search ..... 206/349, 376, 216; 81/177.4, 490; 173/171; 144/136 R, 136 ZR; 269/290; 408/241 R; 409/182; 279/1 K

[56] References Cited

U.S. PATENT DOCUMENTS 1,712,343 5/1929 Gerhardt ..... 81/490

3,416,395 12/1968 Hanson ..... 81/177.4

4,434,828 3/1984 Trincia ..... 145/62

4,586,615 5/1986 Quitmann ..... 211/70.6

*Primary Examiner*—Paul T. Sewell

*Assistant Examiner*—Thomas P. Hilliard

*Attorney, Agent, or Firm*—David L. Davis

[57] ABSTRACT

A wrench storage arrangement for a router wherein the router housing is formed with a cavity and apertures communicating with the cavity are provided on diametrically opposed sides of the cavity. For storage purposes, the wrench handle is caused to extend through the apertures. Within the cavity are a pair of beams which extend toward each other, each of the beams having a longitudinal rib. The wrench handle is formed with notches on the opposed side surfaces, which notches engage the ribs to provide a retention detent.

5 Claims, 2 Drawing Sheets

WRENCH STORAGE ARRANGEMENT FOR A POWER TOOL

BACKGROUND OF THE INVENTION

This invention relates to power tools and, more particularly, to an arrangement for storing a wrench or the like in close association with the power tool.

In the use of a power tool, such as, for example, a router, a hand tool, such as a wrench, may be required to make adjustments or change the bit used with the power tool. When this is the case, the operator must be able to quickly locate the hand tool. If the hand tool is not closely associated with the power tool, this may require some searching and, in the worst case, may result in the hand tool being lost. Arrangements have been proposed for holding such a hand tool on the electric line cord of the power tool. However, this has a number of disadvantages. For example, as the power tool is moved while in use, the hand tool may catch on an edge of a work table or work surface and prevent further movement of the power tool or may cause erratic motion of the power tool which will result in damage to the work. It is therefore an object of the present invention to provide an arrangement for storing a hand tool in close association with the power tool with which it is used, which arrangement keeps the hand tool free of obstruction so as not to interfere with the use of the power tool.

SUMMARY OF THE INVENTION

The foregoing and additional objects are attained in accordance with the principles of this invention by providing an arrangement for releasably retaining a wrench or the like in the housing of a power tool, the housing being formed with an internal cavity and a pair of apertures communicating with the cavity, the pair of apertures being in opposed relation with each other across a major dimension of the cavity, the arrangement comprising resilient beam means extending into the cavity in a direction transverse to a line extending between the apertures, the wrench and the beam means being formed with complementary mating surface regions so that when the wrench extends through the apertures into the cavity, the surface regions engage one with the other and the resilience of the beam means acts to releasably retain the wrench in a storage position.

In accordance with an aspect of this invention, the beam means includes a beam extending into the cavity, the beam being formed with a longitudinal rib, and a side surface of the wrench is formed with a notch which aligns with the rib when the wrench extends through the apertures so that the rib engages the notch to releasably retain the wrench in a storage position.

BRIEF DESCRIPTION OF THE DRAWINGS

The foregoing will be more readily apparent upon reading the following description in conjunction with the drawings in which like elements in different figures thereof have the same reference numeral and wherein.

DETAILED DESCRIPTION

Figure 1:
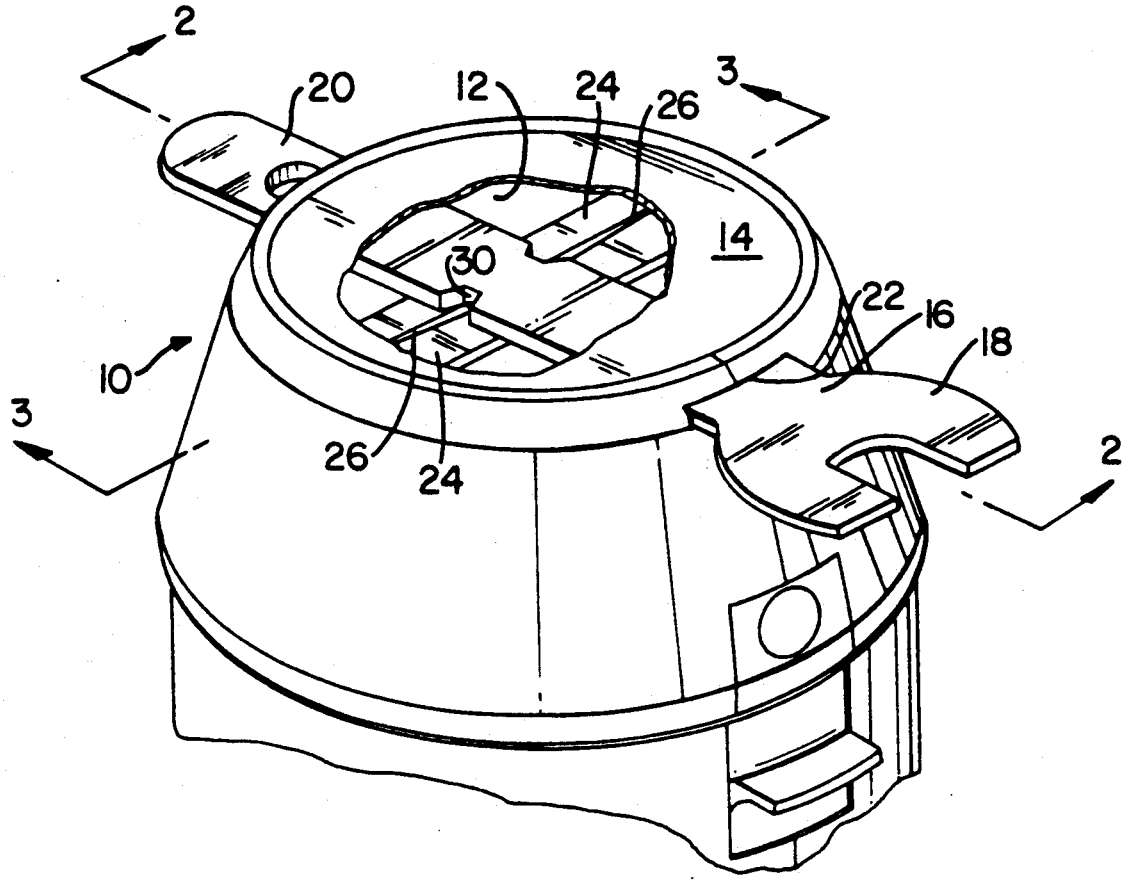
FIG. 1 is a perspective view of the top of a router housing, with the top partially broken away, showing a wrench stored therein according to this invention.
Figure 4:
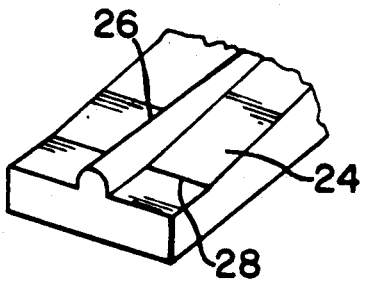
FIG. 4 is a partial perspective view of a retention beam constructed according to this invention.
Figure 2:
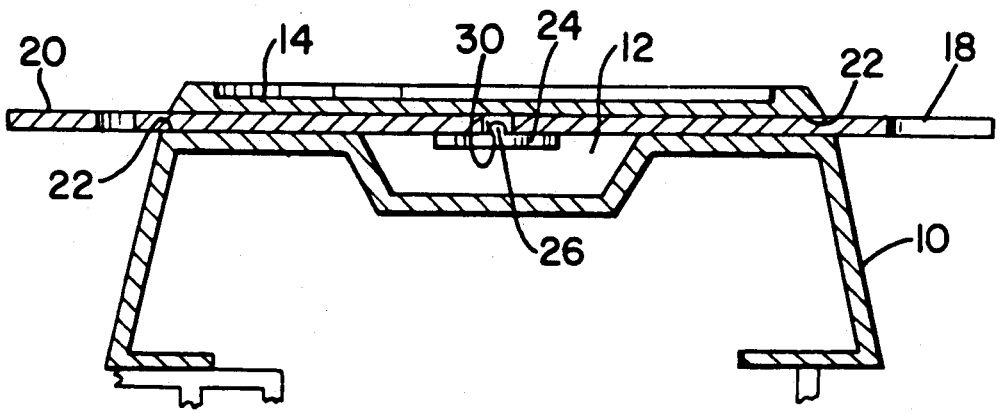
FIG. 2 is a cross-sectional view taken along the line 2—2 in FIG. 1.

Referring now to the drawings, FIG. 1 illustrates the top of a router housing 10 constructed according to this invention. The housing 10 is formed with an internal cavity 12 which may be covered by the top 14 of the housing 10. To change the router bits, there is provided a wrench 16 having a head 18 at one end of a generally flat and elongated handle 20.

The housing 10 is formed with a pair of apertures 22 which communicate with the cavity 12, the shape of the apertures 22 being complemental to the cross-sectional shape of the wrench handle 20 which is illustratively substantially rectangular. The apertures 22 are across a major dimension of the cavity 12 from each other. As illustrated, the housing 10 is generally circular in plan view so that the apertures 22 are along a diameter thereof.

According to this invention, a pair of beams 24 are integrally molded as part of the housing 10, and extend into the cavity 12 in a direction transverse to a line extending between the apertures 22. Each of the beams 24 is formed with a longitudinal rib 26. At the distal ends of the beams 24, the opposed major surfaces are parallel up to the line 28, after which the major surface having the rib 26 is gradually drafted so that the rib 26 gradually disappears. For cooperation with the ribs 26, the wrench handle 20 is formed with a pair of notches 30, preferably trapezoidal in shape, formed in its side surfaces. The notches 30 are at opposite ends of a line orthogonal to the longitudinal axis of the wrench handle 20. The ribs 26 of the beams 24 are co-linear and the notches 30 align with the ribs 26 when the wrench 16 extends through the apertures 22. The housing 10 is preferably molded of plastic and the beams 24 are integrally molded therewith. Accordingly, the beams 24 are resilient. Therefore, as the wrench handle 20 is extended into the cavity 12 through a first one of the apertures 22, it downwardly deflects the beams 24 out of the way. Further movement of the wrench handle 20 out of the other aperture 22 finally results in the notches 30 aligning with the ribs 26, which causes an interengagement therebetween in a detent manner so that the wrench 16 is releasably retained in a storage position in the housing 10.

Figure 3:
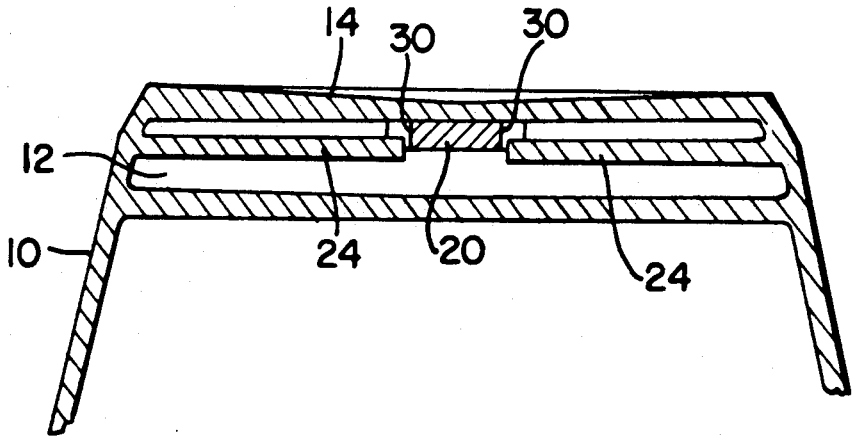
FIG. 3 is a cross-sectional view taken along the line 3—3 in FIG. 1.

As is most clear from FIG. 3, the beams 24 are so formed that the lines 28 are spaced from the distal ends of the beams 24 a distance substantially equal to the depth of the notches 30. This provides a secure retention of the wrench 16. For ease in use, the notches 30 are provided on both side surfaces of the wrench handle 20 and a pair of beams 24 are provided so that the user is not forced to remember which major surface of the wrench 16 should be up or down, this resulting in improved ease of use.

Accordingly, there has been disclosed an improved arrangement for releasably retaining a wrench in the housing of a power tool. While a preferred embodiment has been disclosed, it will be apparent to one of ordinary skill in the art that various modifications and adaptations to the disclosed arrangement can be made without departing from the spirit and scope of this invention, which is only intended to be limited by the appended claims.

What is claimed is:

1. A power tool housing in combination with an arrangement for releasably retaining a hand tool in the housing, the housing being formed with an internal cavity and a pair of apertures communicating with said cavity, said pair of apertures being in opposed relation with each other across a major dimension of said cavity, the arrangement comprising:

resilient beam means extending into said cavity in a direction transverse to a line extending between said apertures;

said hand tool and said beam means being formed with complementary mating surface regions so that when said hand tool extends through said apertures into said cavity, said surface regions engage one with the other and the resilience of said beam means acts to releasably retain said hand tool in a storage position.

2. The arrangement according to claim 1 wherein said beam means includes a first beam extending into said cavity, said first beam being formed with a longitudinal rib, and a first side surface of said hand tool is formed with a first notch which aligns with said rib when said hand tool extends through said apertures so that said rib engages said first notch to releasably retain said hand tool in a storage position.

3. The arrangement according to claim 2 wherein said housing is molded from a plastic material and said first beam is integrally molded as part of said housing.

4. The arrangement according to claim 2 wherein said hand tool is formed with a second notch on a second side surface opposite said first side surface, and said beam means includes a second beam extending into said cavity from a side opposite said first beam, said second beam being formed with a longitudinal rib for engaging said second notch.

5. The arrangement according to claim 4 wherein said first and second notches are at opposite ends of a line orthogonal to the longitudinal axis of said hand tool, and said ribs of said first and second beams are co-linear.

* * * * *